US007973726B2

(12) United States Patent
Tseng et al.

(10) Patent No.: US 7,973,726 B2
(45) Date of Patent: Jul. 5, 2011

(54) MULTI-ANTENNA MODULE

(75) Inventors: Yi-Wei Tseng, Taipei County (TW); Sheng-Chih Lin, Taipei County (TW); Tsung-Wen Chiu, Taipei County (TW); Fu-Ren Hsiao, Taipei County (TW)

(73) Assignee: Advanced Connectek, Inc., Taipei County (TW)

( * ) Notice: Subject to any disclaimer, the term of this patent is extended or adjusted under 35 U.S.C. 154(b) by 520 days.

(21) Appl. No.: 12/208,273

(22) Filed: Sep. 10, 2008

(65) Prior Publication Data

US 2009/0231200 A1 Sep. 17, 2009

(30) Foreign Application Priority Data

Mar. 14, 2008 (TW) ..... 97109034 A

(51) Int. Cl.
*H01Q 1/24* (2006.01)

(52) U.S. Cl. ..... 343/702; 343/700 MS; 343/829; 343/846; 343/833

(58) Field of Classification Search ..... 343/700 MS, 343/702, 829, 846, 833
See application file for complete search history.

(56) References Cited

U.S. PATENT DOCUMENTS 7,298,339 B1 * 11/2007 Ollikainen ..... 343/702
7,375,695 B2 * 5/2008 Ishizuka et al. ..... 343/745
7,439,914 B1 * 10/2008 Lin et al. ..... 343/700 MS
7,525,490 B2 * 4/2009 Hung et al. ..... 343/702
7,633,448 B2 * 12/2009 Su et al. ..... 343/702
7,701,401 B2 * 4/2010 Suzuki et al. ..... 343/702
7,724,201 B2 * 5/2010 Nysen et al. ..... 343/821
7,834,809 B2 * 11/2010 Tseng et al. ..... 343/700 MS
2009/0174611 A1 * 7/2009 Schlub et al. ..... 343/702

FOREIGN PATENT DOCUMENTS

TW 268010 B 12/2006

* cited by examiner

*Primary Examiner* — Douglas W Owens
*Assistant Examiner* — Chuc D Tran
(74) *Attorney, Agent, or Firm* — Schmeiser Olsen & Watts LLP

(57) ABSTRACT

A multi-antenna module comprises a ground plane, a primary conductor, a secondary conductor and a plurality of coupling conductors, wherein the framework of the parallel primary radiation arm and secondary radiation arm can infinitely expand the number of antenna units in the same antenna structure. The capacitive coupling effect of parallel radiation arms and the inductance of the radiation arms themselves can effectively reduce the signal interference between antennae, whereby a plurality of antennae can be integrated to achieve antenna miniaturization. The primary conductor, the secondary conductor and the coupling conductors are all connected to the same ground plane, whereby the layout space is reduced, and the multi-antenna module is easy-to-assemble for various electronic devices.

9 Claims, 7 Drawing Sheets

MULTI-ANTENNA MODULE

BACKGROUND OF THE INVENTION

1. Field of the Invention

The present invention relates to a multi-antenna module, particularly to a multi-antenna module, wherein the number of antenna units can be infinitely expanded in the same antenna structure.

2. Description of the Related Art

With the popularization of wireless communication, there are also many advances in antenna technology. Particularly, many types of Combo antenna systems have been developed to meet the tendency of miniaturizing antennae and fabricating multi-frequency communication devices, wherein different antenna structures are integrated into a single antenna module to attain a multi-frequency function and reduce the sizes of antenna systems.

Refer to FIG. 1. A Taiwanese patent No. I268010 discloses an antenna integration system for mobile phones, which comprises a baseplate 104, a planar Inverted F antenna 101, a monopole antenna 102, and a planar antenna 103. The planar Inverted F antenna 101 has a feeder point 105 and ground point 106. The monopole antenna 102 has a feeder point 107, and the planar antenna 103 has a feeder point 108. The minimum spacing between the planar Inverted F antenna 101 and the monopole antenna 102 is 6 mm. The minimum spacing between the planar Inverted F antenna 101 and the planar antenna 103 is 2 mm. In such a structure, the appropriate spacing between antennae can effectively reduce the isolation interference and enable the antennae to transmit and receive signals normally.

Referring to FIG. 2*a* and FIG. 2*b*, FIG. 2*a* is a diagram showing the measurement results of the isolation (S21) of the planar Inverted F antenna and the monopole antenna. FIG. 2*b* is a diagram showing the measurement results of the isolation (S21) of the planar Inverted F antenna and the planar antenna. From the measurement results, it is known that the antenna integration system has a better isolation than other prior arts.

To reduce the radiation interference among the antennae, the planar Inverted F antenna 101 is arranged on a first face of the baseplate 104, and the monopole antenna 102 is arranged on a lateral side of the baseplate 104, and the planar antenna 103 is arranged on the first face of the baseplate 104 but far away from the monopole antenna 102. Such a layout should increase the difficulty of installing the antenna integration system and make the antenna system hard to integrate with electronic products. The spacing between antennae has to be at least 6 mm or at least 2 mm, which greatly increases the space occupied by the system. However, the radiation efficiency of the antenna integration system is hard to obviously increase thereby. Further, the isolation effect between the antennae is likely to be constrained. In fact, the prior-art antenna integration system seldom achieves the announced function completely.

SUMMARY OF THE INVENTION

One objective of the present invention is to provide a multi-antenna module, which comprises a ground plane, a primary conductor, a secondary conductor and a plurality of coupling conductors, and which features sharing radiation conductors and a ground plane, whereby the layout space of antennae is greatly reduced, and whereby the multi-antenna module of the present invention is easy-to-assemble for various electronic devices.

Another objective of the present invention is to provide a multi-antenna module, wherein the framework of the parallel primary radiation arm and secondary radiation arm can infinitely expand the number of antenna units in the same antenna structure, and wherein the interference between antennae is reduced, whereby the present invention has multiple operation frequency bands and can apply to multiple communication systems, and whereby the present invention achieves antenna miniaturization.

A further objective of the present invention is to provide a multi-antenna module, wherein the capacitive coupling effect of parallel radiation arms and the inductance of the radiation arms themselves form a high-pass or low-pass filter, whereby the isolation of antennae is effectively increased.

To achieve the abovementioned objectives, the present invention proposes a multi-antenna module, which comprises a ground plane, a primary conductor, a secondary conductor and a plurality of coupling conductors. The primary conductor further comprises a first short-circuit member and a primary radiation arm. The secondary conductor further comprises a second short-circuit member, a secondary radiation arm, an extension arm and a first feeder cable. The coupling conductor further comprises a feeder member, a coupling arm and a second feeder cable. One end of the first short-circuit member of the primary conductor is connected to the ground plane. The primary radiation arm is connected to the other end of the first short-circuit member and extends from the first short-circuit member along a first direction. One end of the second short-circuit member of the secondary conductor is connected to the ground plane. The secondary radiation arm is connected to the other end of the second short-circuit member and extends from the second short-circuit member along a second direction opposite to the first direction. The primary radiation arm and the secondary radiation arm are parallel to each other and have a gap therebetween. The extension arm is connected to the joint interface of the second short-circuit member and the secondary radiation arm, and extends from the second short-circuit member along the first direction. The first feeder cable is connected to the secondary radiation arm. The coupling arm of the coupling conductor is connected to one end of the feeder member and extends from the feeder member along the second direction. The secondary radiation arm and the coupling arm are parallel to each other and have a gap therebetween. The second feeder cable is connected to the feeder member.

In a first embodiment of the present invention, the secondary radiation arm of the secondary conductor receives microwave signals of a first antenna from the first feeder cable. The microwave signals are then transmitted to the extension arm, the second short-circuit member, and the ground plane. Via the capacitive coupling effect of the secondary radiation arm and the primary radiation arm, the signals are coupled to the primary conductor. The primary conductor receives the electrically-coupled signals from the secondary radiation arm and further transmits the signals to the first short-circuit member and the ground plane. Thus, the primary radiation arm, the secondary radiation arm, the extension arm, the first short-circuit member, and the second short-circuit member jointly form the main radiation structure of the first antenna. Then, the primary conductor and the secondary radiation arm excite a first resonant mode of the first antenna, and the extension arm excites a second resonant mode of the first antenna. A capacitive effect is created between the coupling conductor and the extension arm, and an inductive effect is created in the coupling conductor itself. Then, a filter, which can effectively protect a second antenna from the interference of the signals of the first antenna, will be formed via appropriately adjusting the gap and the thickness and serpentinity of the coupling conductor.

In the first embodiment, the signal filters are formed by the integration structure of the ground plane, the primary conductor, the secondary conductor and the coupling conductor together with the capacitive coupling effect of the parallel radiation arms and inductance of the conductors. The signal filters can effectively reduce the mutual interference between the first antenna and the second antenna. Thus, additional spacing is unnecessary between two adjacent antennae, and the dimensions of the antenna system are greatly reduced. Further, a superior isolation can still be achieved thereby. As the antennae of the present invention share parts of the radiation conductors, the layout size of the antennae is greatly reduced, and the assembly process thereof is simplified.

A second embodiment is basically similar to the first embodiment except the primary conductor additionally has an extension arm in the second embodiment. A first extension arm is connected to the joint of the first short-circuit member and the primary radiation arm and extends from the first short-circuit member along the second direction. Further, a second coupling conductor is arranged beside the first extension arm in the second embodiment. The second coupling conductor has a second coupling arm. The second coupling arm of the second coupling conductor and the first extension arm of the primary conductor are parallel to each other and have a gap therebetween.

The second feeder member receives feed-in signals from the third feeder cable of the second coupling conductor and transmits the signals to the second coupling arm. The second coupling arm couples the signals to the extension arm, and the extension arm transmits the signals to the first short-circuit member and the ground plane. Thus, the extension arm, the second coupling arm, the first short-circuit member, and the second feeder member jointly form the main radiation structure of a third antenna. The extension arm and the second coupling arm excite a resonant mode of the third antenna.

In the second embodiment, the framework of parallel primary radiation arm and secondary radiation arm can infinitely expand the number of antenna units in the same antenna structure. Filters, which can effectively reduce the interference between antennae, can be formed via appropriately adjusting the capacitive coupling effect of parallel radiation arms and the inductance of the radiation conductors. Thereby, multiple antennae can be integrated into the same antenna structure to share the radiation conductors and greatly reduce the layout space of antennae. Thus, the present invention can achieve antenna miniaturization and multiple operation frequency bands and apply to many communication systems. Further, the present invention is easy-to-assemble for various electronic devices

DETAILED DESCRIPTION OF THE INVENTION

Figure 1:
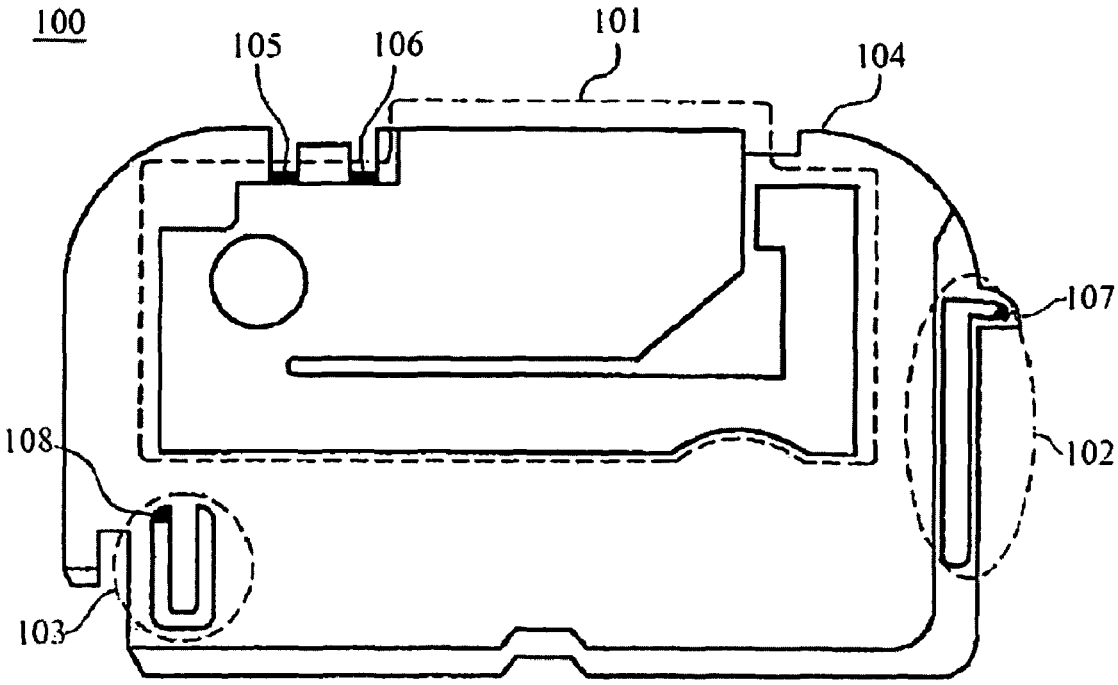
FIG. 1 is a top view showing an antenna integration system for mobile phones disclosed by a Taiwanese patent No. I268010.
Figure 2A:
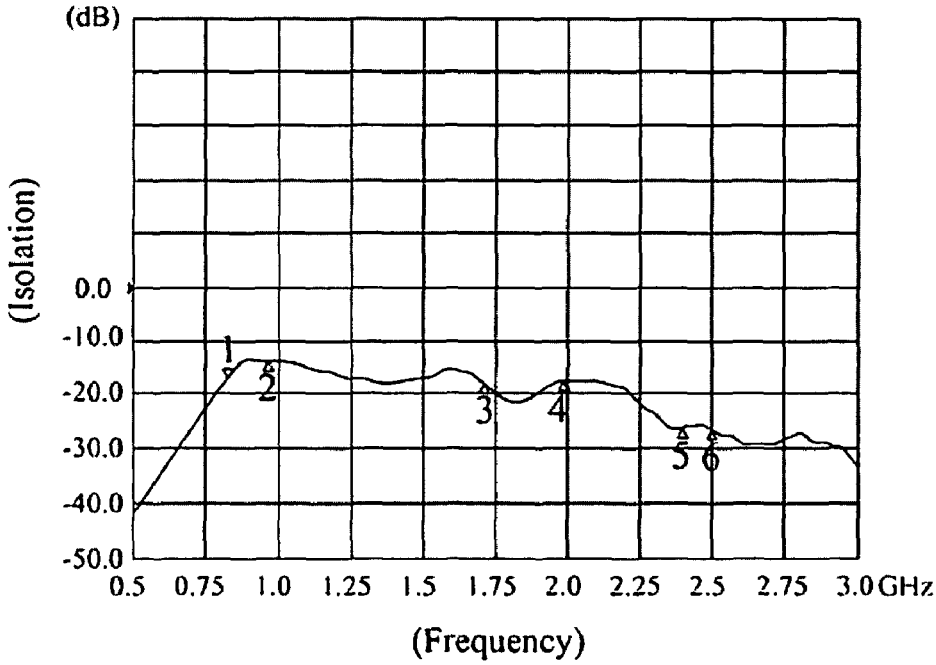
FIG. 2*a* is a diagram showing the measurement results of the isolation (S21) of a conventional planar Inverted F antenna and a conventional monopole antenna.
Figure 2B:
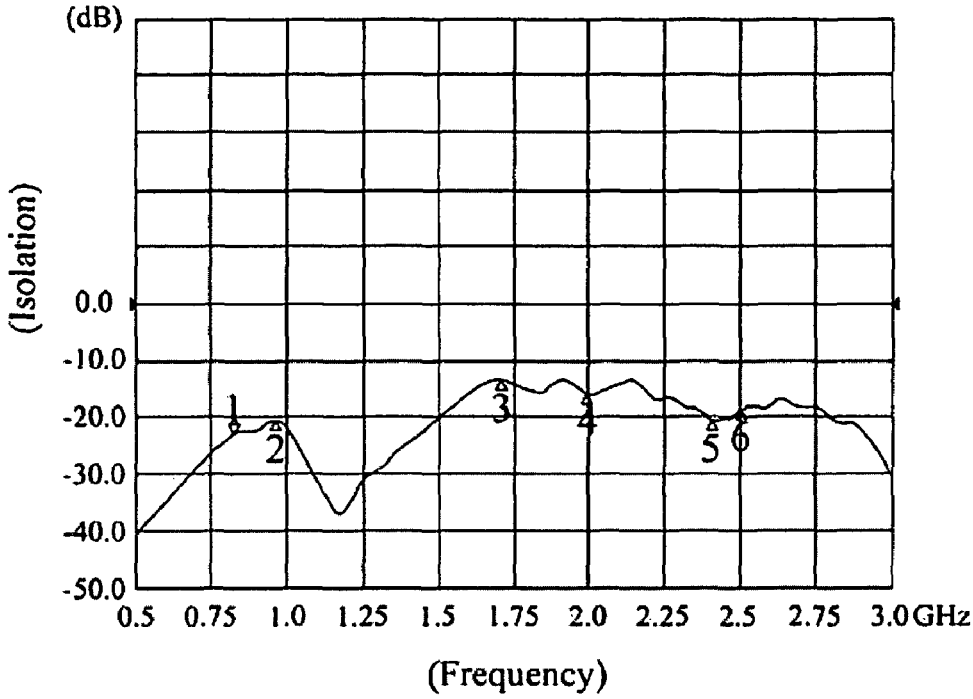
FIG. 2*b* is a diagram showing the measurement results of the isolation (S21) of a conventional planar Inverted F antenna and a conventional planar antenna.
Figure 3:
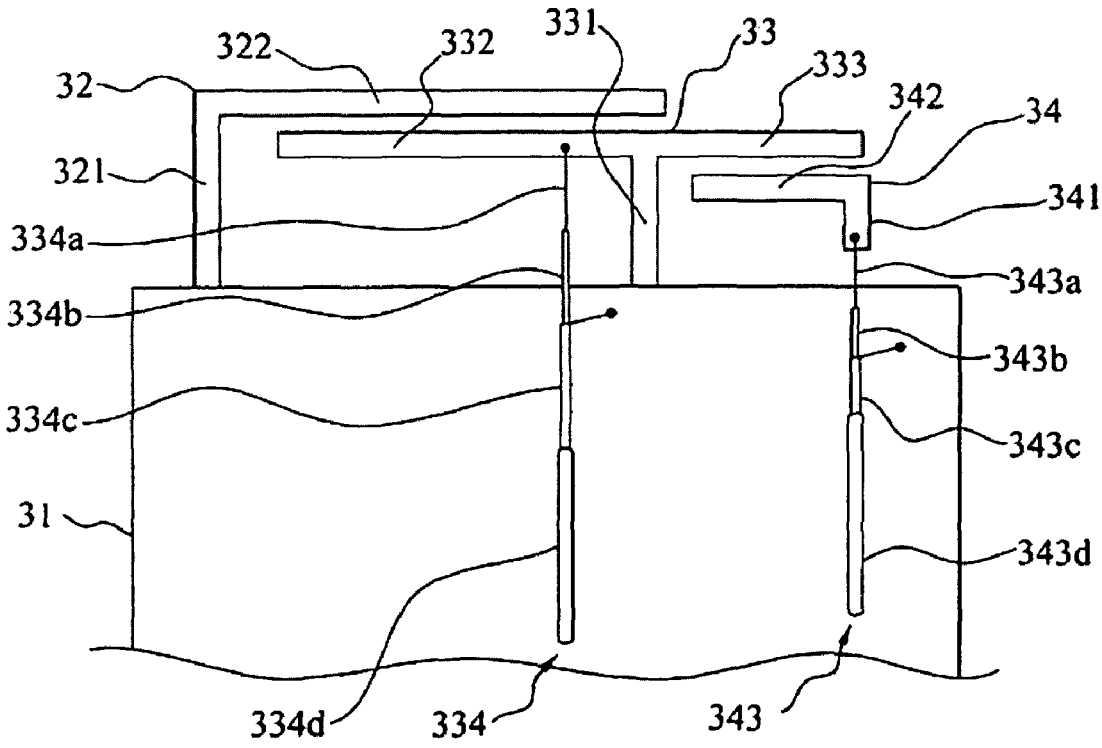
FIG. 3 is a top view schematically showing a multi-antenna module according to a first embodiment of the present invention.

Referring to FIG. 3 a top view of a multi-antenna module according to a first embodiment of the present invention, the multi-antenna module of the present invention comprises a ground plane 31, a primary conductor 32, a secondary conductor 33 and a coupling conductor 34. The primary conductor 32 further comprises a first short-circuit member 321 and a primary radiation arm 322. The secondary conductor 33 further comprises a second short-circuit member 331, a secondary radiation arm 332, an extension arm 333 and a first feeder cable 334. The coupling conductor 34 further comprises a feeder member 341, a coupling arm 342 and a second feeder cable 343.

One end of the first short-circuit member 321 of the primary conductor 32 is connected to the ground plane 31. One end of the primary radiation arm 322 is connected to the other end of the first short-circuit member 321, and the primary radiation arm 322 extends from the first short-circuit member 321 along a first direction. One end of the second short-circuit member 331 of the secondary conductor 33 is connected to the ground plane 31. One end of the secondary radiation arm 332 is connected to the other end of the second short-circuit member 331, and the secondary radiation arm 332 extends from the second short-circuit member 331 along a second direction opposite to the first direction. The primary radiation arm 322 and the secondary radiation arm 332 are parallel to each other and have a gap therebetween. One end of the extension arm 333 is connected to the joint interface of the second short-circuit member 331 and the secondary radiation arm 332, and the extension arm 333 extends from the second short-circuit member 331 along the first direction. The first feeder cable 334 contains a central conductor 334*a*, an inner insulation layer 334*b*, external conductor 334*c* and an external insulation layer 334*d* in sequence from the center. The central conductor 334*a* of the first feeder cable 334 is connected to the secondary radiation arm 332. The external conductor 334*c* is connected to the ground plane 31.

The primary radiation arm 322 has a length of about 45 mm and a width of about 2 mm. The secondary radiation arm 332 has a length of about 32 mm and a width of about 2 mm. The first short-circuit member 321 has a length of about 12 mm and a width of about 2 mm. The second short-circuit member 331 has a length of about 9 mm and a width of about 2 mm.

The secondary radiation arm 332 of the secondary conductor 33 receives microwave signals of a first antenna from the first feeder cable 334. The microwave signals are then transmitted to the extension arm 333, the second short-circuit member 331, and the ground plane 31. Via the capacitive coupling effect of the secondary radiation arm 332 and the primary radiation arm 322, the signals are coupled to the primary conductor 32. The primary conductor 32 receives the electrically-coupled signals from the secondary radiation arm 332 and further transmits the signals to the first short-circuit member 321 and the ground plane 31. Thus, the primary radiation arm 322, the secondary radiation arm 332, the extension arm 333, the first short-circuit member 321, and the second short-circuit member 331 jointly form the main radiation structure of the first antenna. Then, the primary conductor 32 and the secondary radiation arm 332 excite a first resonant mode of the first antenna, and the extension arm 333 excites a second resonant mode of the first antenna. A capacitive effect is created between the coupling conductor 34 and the extension arm 333, and an inductive effect is created in the coupling conductor 34 itself. Then, a filter, which can effectively protect a second antenna from the interference of the signals of the first antenna, will be formed via appropriately adjusting the gap and the thickness and serpentinity of the coupling conductor 34.

One end of the coupling arm 342 of the coupling conductor 34 is connected to one end of the feeder member 341, and the coupling arm 342 extends from the feeder member 341 along the second direction. The secondary radiation arm 332 and the coupling arm 342 are parallel to each other and have a gap therebetween. The second feeder cable 343 contains a central conductor 343*a*, an inner insulation layer 343*b*, external conductor 343*c* and an external insulation layer 343*d* in sequence from the center. The central conductor 343*a* of the second feeder cable 343 is connected to the feeder member 341. The external conductor 343*c* is connected to the ground plane 31.

The extension arm 333 has a length of about 12 mm and a width of about 2 mm. The coupling arm 342 has a length of about 13 mm and a width of about 2 mm. The feeder member 341 has a length of about 3 mm and a width of about 2 mm. The second short-circuit member 331 has a length of about 9 mm and a width of about 2 mm.

The feeder member 341 receives feed-in signals from a second antenna via the second feeder cable 343 and transmits the signals to the coupling arm 342. Then, the signals are coupled to the extension arm 333 by the coupling arm 342. The extension arm 333 transmits the signals to the second short-circuit member 331 and the ground plane 31. Thus, the extension arm 333, the coupling arm 342, the second short-circuit member 331 and the feeder member 341 jointly form the main radiation structure of the second antenna. Then, the extension arm 333 and the coupling arm 342 excite a resonant mode of the second antenna. A capacitive effect is created between the primary radiation arm 322 and the secondary radiation arm 332, and an inductive effect is created in secondary conductor 33 itself. Then, a filter, which can effectively protect the first antenna against the interference of the signals of the second antenna, will be formed via appropriately adjusting the gap and the thickness and serpentinity of the secondary conductor 33.

In this embodiment, the signal filters are formed by the integration structure of the ground plane 31, the primary conductor 32, the secondary conductor 33 and the coupling conductor 34 together with the capacitive coupling effect of the parallel radiation arms and inductance of the conductors. The signal filters can effectively reduce the mutual interference between the first antenna and the second antenna. Thus, additional spacing is unnecessary between two adjacent antennae, and the dimensions of the antenna system are greatly reduced. Further, a superior isolation can still be achieved thereby. As the antennae of the present invention share parts of the radiation structures, the layout size of the antennae is greatly reduced, and the assembly process thereof is simplified.

Figure 4:
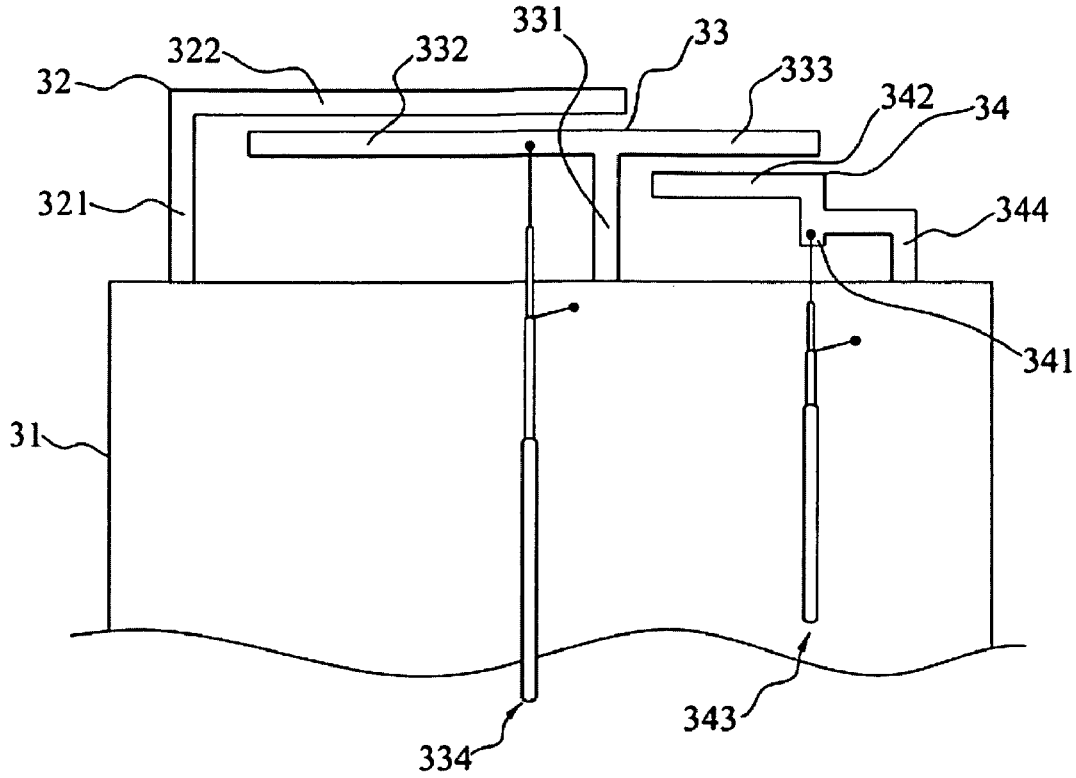
FIG. 4 is a top view schematically showing a variation of the first embodiment of the present invention.

A top view of a variation of the first embodiment of the present invention is as shown in FIG. 4. In this variation, a modulation member 344 is arranged beside the coupling conductor 34. One end of the modulation member 344 is connected to the lateral of the coupling conductor 34, and the other end of the modulation member 344 is connected to the ground plane 31. The modulation member 344 is used to modulate the impedance matching of the coupling conductor 34 of the second antenna system, whereby the second antenna system has a better impedance-variation performance.

Figure 5:
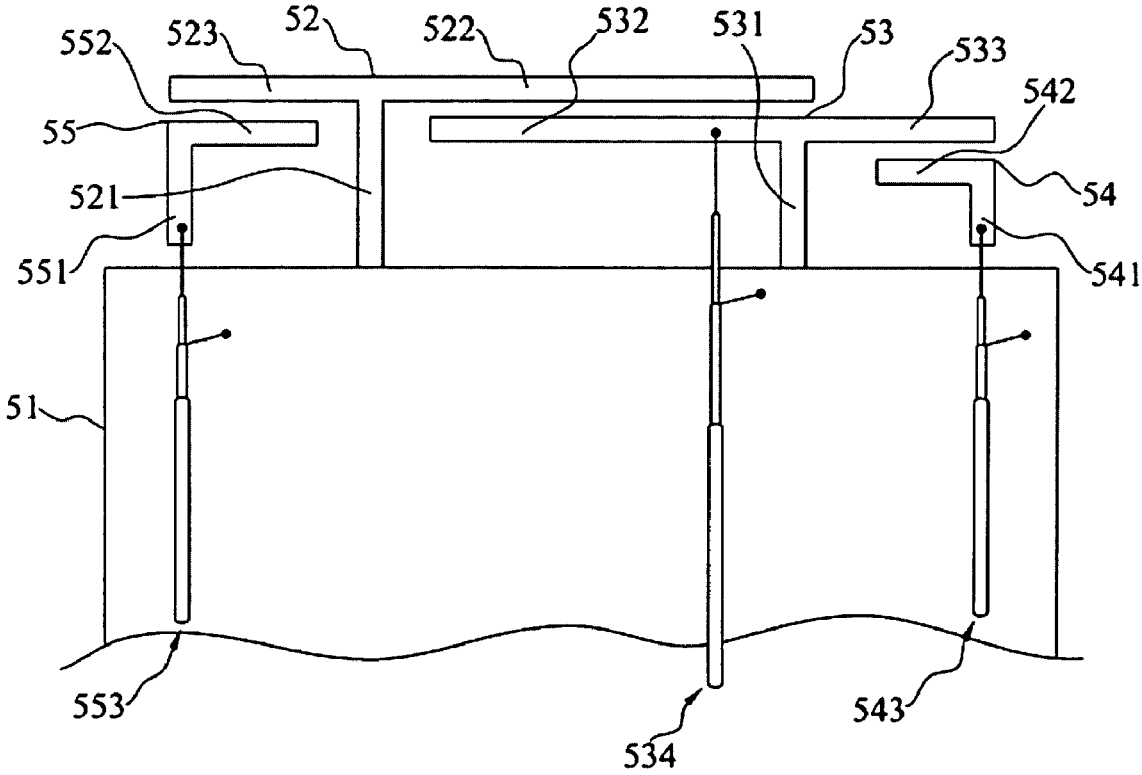
FIG. 5 is a top view schematically showing a multi-antenna module according to a second embodiment of the present invention.

A top view of a second embodiment of the present invention is as shown in FIG. 5. This second embodiment is basically similar to the first embodiment and comprises a ground plane 51, a primary conductor 52, a secondary conductor 53, a first coupling conductor 54 and a second coupling conductor 55. The primary conductor 52 further comprises a first short-circuit member 521, a primary radiation arm 522 and a first extension arm 523. The secondary conductor 53 further comprises a second short-circuit member 531, a secondary radiation arm 532, a second extension arm 533 and a first feeder cable 534. The first coupling conductor 54 further comprises a first feeder member 541, a first coupling arm 542 and a second feeder cable 543. The second coupling conductor 55 further comprises a second feeder member 551, a second coupling arm 552 and a third feeder cable 553.

The second embodiment is different from the first embodiment in that the primary conductor 52 has an additional first extension arm 523. The first extension arm 523 is connected to the joint of the first short-circuit member 521 and the primary radiation arm 522 and extends from the first short-circuit member 521 along the second direction. The second embodiment further has a second coupling conductor 55 arranged beside the first extension arm 523. The second coupling arm 552 of the second coupling conductor 55 and the first extension arm 523 of the primary conductor 52 are parallel to each other and have a gap therebetween. The third feeder cable 553 is connected to the second feeder member 551.

The second feeder member 551 receives a feed-in signal from the third feeder cable 553 and transmits the signal to the second coupling arm 552. The second coupling arm 552 couples the signal to the first extension arm 523, and the first extension arm 523 transmits the signal to the first short-circuit member 521 and the ground plane 51. Thus, the first extension arm 523, the second coupling arm 552, the first short-circuit member 521, and the second feeder member 551 jointly form the main radiation structure of a third antenna. The first extension arm 523 and the second coupling arm 552 excite a resonant mode of the third antenna.

The second embodiment incorporates multiple antenna units in the framework of the parallel primary radiation arm 522 and secondary radiation arm 532, wherein a capacitive coupling effect is created between the parallel radiation arms, and inductance is created in the radiation conductor 34. Different-frequency filters can be formed via appropriately adjusting the capacitive coupling effect and the inductance to respectively isolate antennae lest they interfere mutually. Thus is formed a multi-antenna module sharing radiation conductors, achieving antenna miniaturization, simplifying assembly procedures, having multiple operation frequency bands and applying to multiple communication systems.

Figure 6:
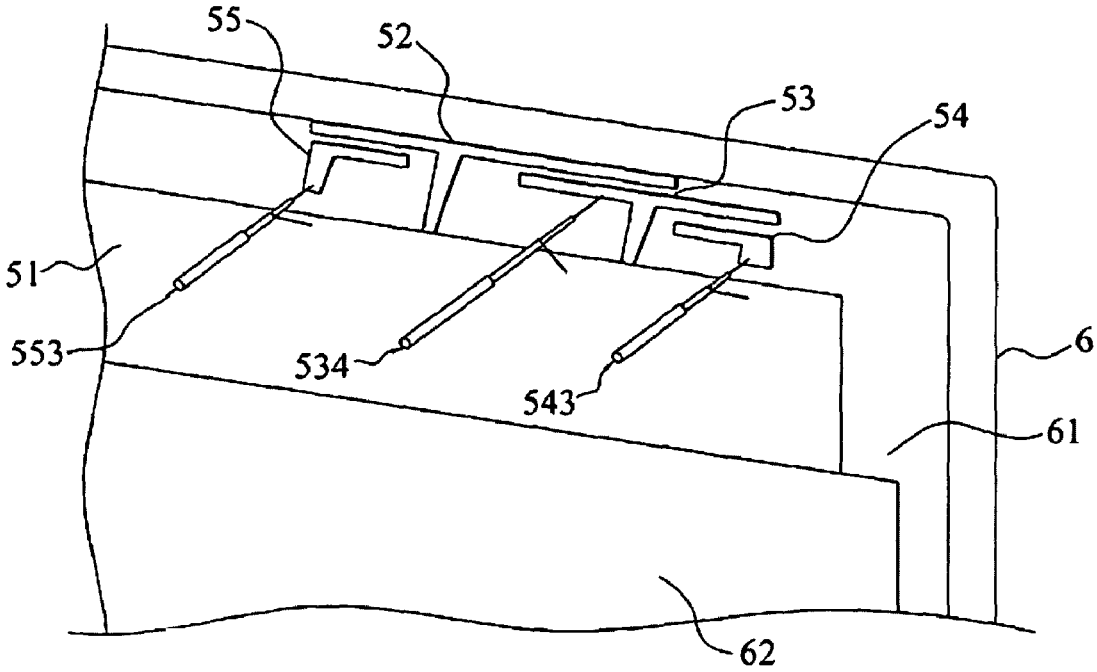
FIG. 6 is a perspective view schematically showing that the second embodiment applies to a portable computer.

Referring to FIG. 6, a perspective view schematically shows that the second embodiment applies to a portable computer. The multi-antenna module of the present invention is arranged in the inner edge of a baseplate 61 of a portable computer 6. The ground plane 51 is made of a tin foil. The entire tin foil is stuck onto the inner surface of the baseplate 61. A screen 62 is arranged above the tin foil and the baseplate 61. The baseplate 61 is used as the ground plane of the entire antenna module, and the tin foil conducts signals from the ground plane 51 to the baseplate 61.

The multi-antenna module of the present invention integrates the conductors of different operational frequencies into an identical antenna module to share radiation conductors. In the present invention, antennae needn't be embedded in the edges of a portable computer, and adjacent antennae do not need additional spacing. Therefore, the multi-antenna module of the present invention is easy-to-layout for various electronic devices, and the assembly process thereof is simplified.

Figure 7:
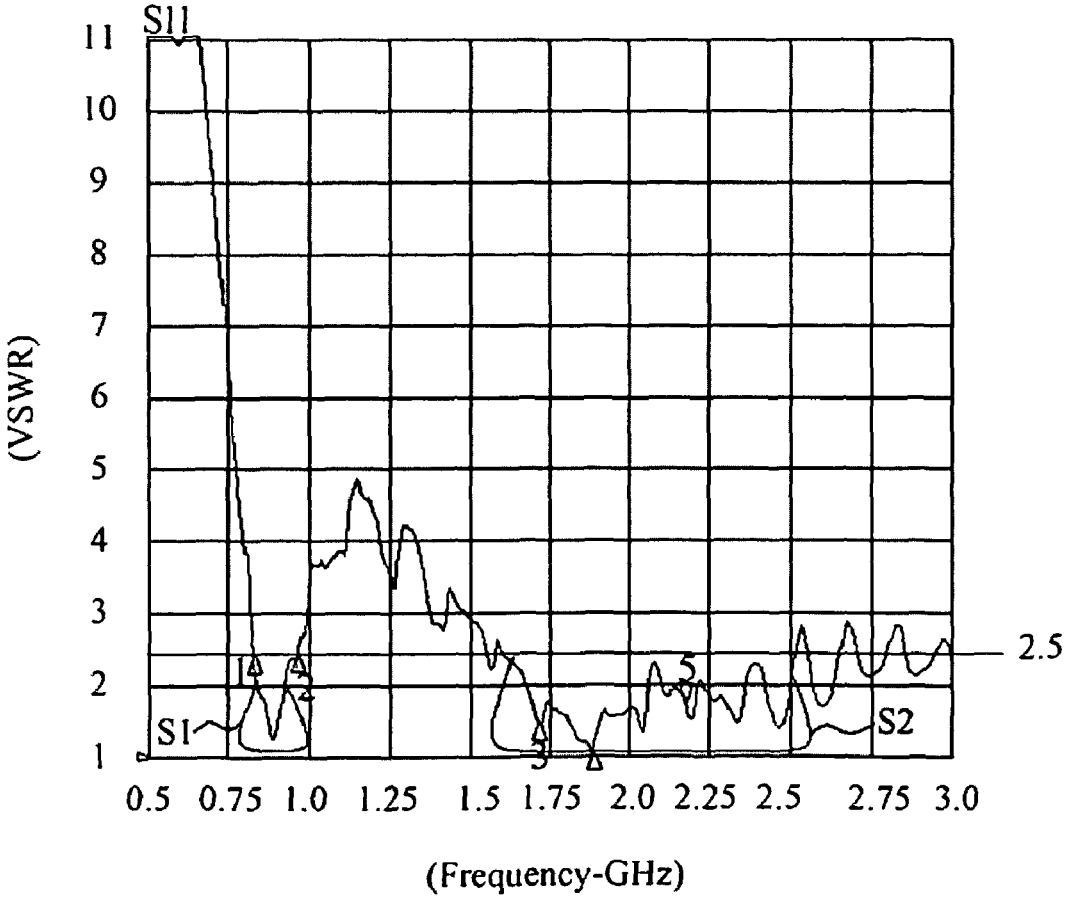
FIG. 7 is a diagram showing the measurement results of the voltage standing wave ratio (VSWR) of a first antenna (a WWAN system) according to the second embodiment of the present invention.

Referring to FIG. 7, a diagram shows the measurement results of the voltage standing wave ratio (VSWR) of the first antenna (a WWAN system) according to the second embodiment of the present invention. When the voltage standing wave ratio of the first antenna is defined to be 2.5, the operation frequency of a bandwidth S1 is between 824 and 960 MHz, which covers the AMPS system (824-894 MHz) and GSM system (880-960 MHz), and the operation frequency of a bandwidth S2 is between 1570 and 2500 MHz, which covers the GPS system (1575 MHz), DCS system (1710-1880 MHz), PCS system (1850-1990 MHz) and UMTS system (1920-2170 MHz).

Figure 8:
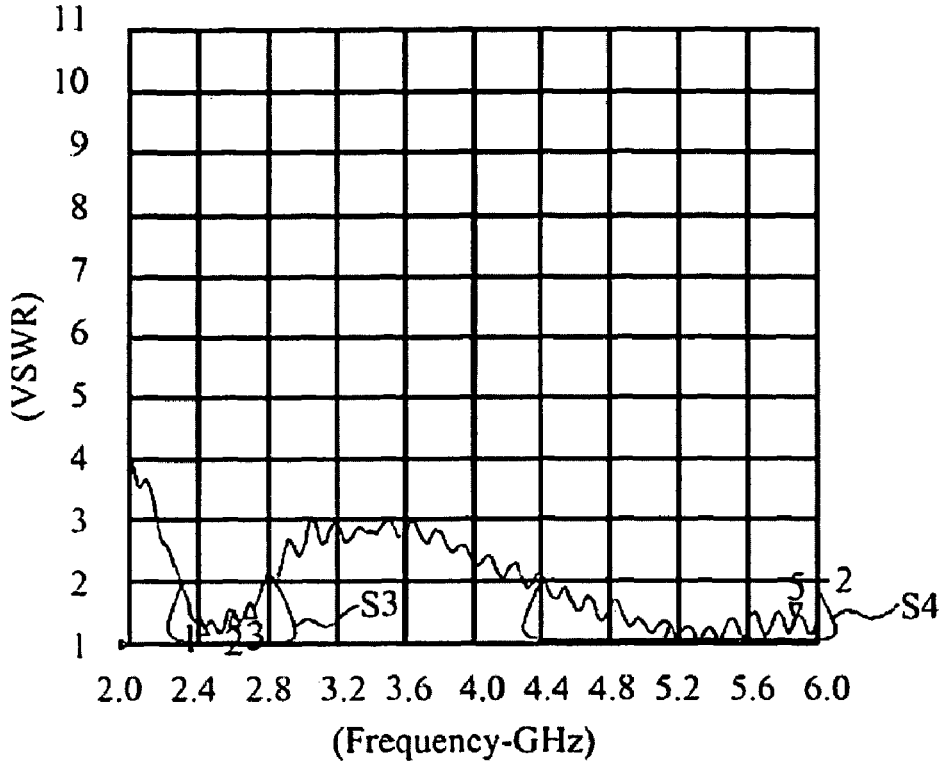
FIG. 8 is a diagram showing the measurement results of the voltage standing wave ratio (VSWR) of a second antenna (a WLAN and WiMAX system) according to the second embodiment of the present invention.

Referring to FIG. 8, a diagram shows the measurement results of the voltage standing wave ratio (VSWR) of the second antenna (a WLAN and WiMAX system) according to the second embodiment of the present invention. When the voltage standing wave ratio of the second antenna is defined to be 2, the operation frequency of a bandwidth S3 is between 2.3 and 2.8 GHz, which covers the WLAN 802.11b/g system (2.4-2.5 GHz), and the operation frequency of a bandwidth S4 is between 4.4 and 6.0 GHz, which covers the WLAN 802.11a system (4.9-5.9 GHz). Besides, the operation frequency of the bandwidth S3 and the bandwidth S4 also overlaps the bandwidth of the WiMAX system (2.6-6.0 GHz).

Figure 9:
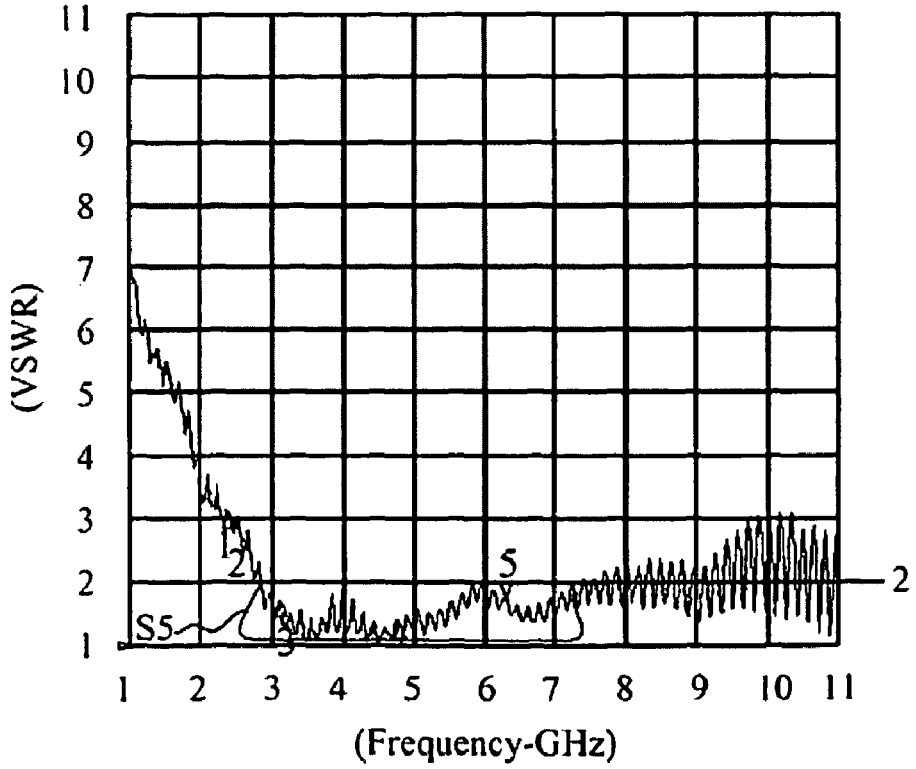
FIG. 9 is a diagram showing the measurement results of the voltage standing wave ratio (VSWR) of a third antenna (a UWB system) according to the second embodiment of the present invention.

Referring to FIG. 9, a diagram shows the measurement results of the voltage standing wave ratio (VSWR) of the third antenna (a UWB system) according to the second embodiment of the present invention. When the voltage standing wave ratio of the third antenna is defined to be 2, the operation frequency of a bandwidth S5 is between 2.9 and 7.2 GHz, which covers the UWB system (3.1-4.9 GHz). From the VSWR measurement results, it is known that the multi-antenna module of the present invention has a superior operation frequency band.

Figure 10:
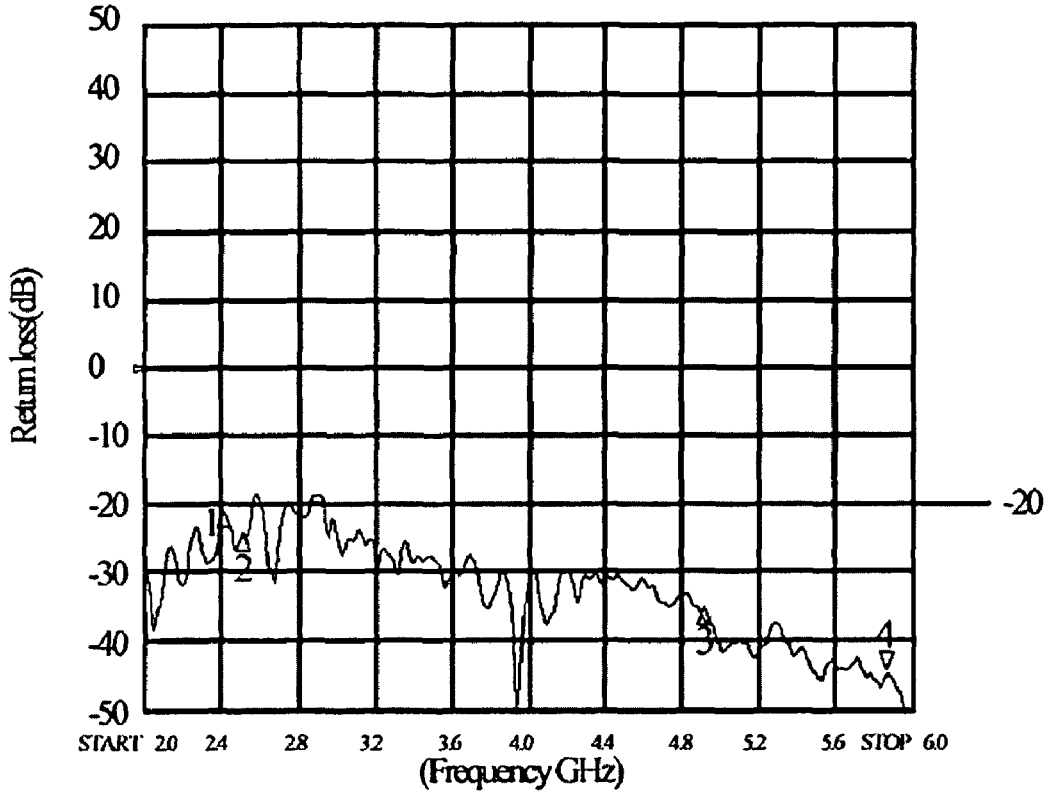
FIG. 10 is a diagram showing the measurement results of the isolation (for the WWAN system and the WLAN system) of the multi-antenna module according to the second embodiment of the present invention.

Referring to FIG. 10, a diagram shows the measurement results of the isolation (for the WWAN and WLAN systems) of the multi-antenna module according to the second embodiment of the present invention. From the measurement results, it is observed that the isolation is below −20 dB for the WWAN and WLAN systems.

Figure 11:
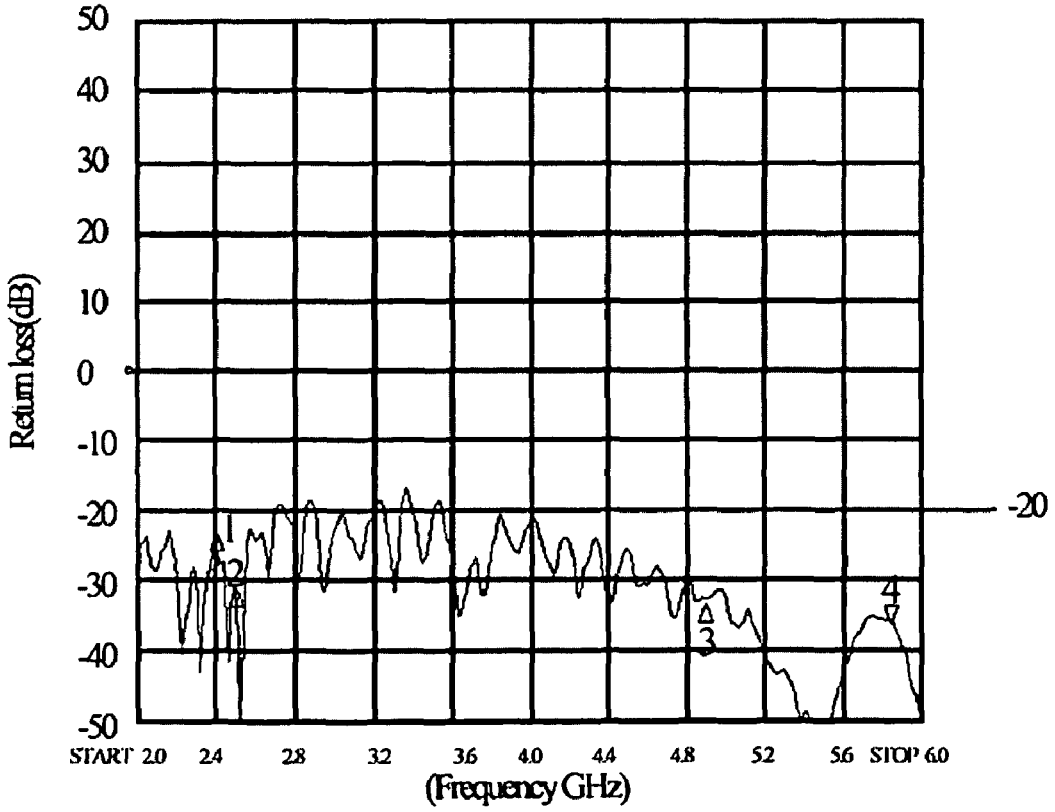
FIG. 11 is a diagram showing the measurement results of the isolation (for the WWAN system and the UWB system) of the multi-antenna module according to the second embodiment of the present invention.

Referring to FIG. 11, a diagram shows the measurement results of the isolation (for the WWAN and UWB systems) of the multi-antenna module according to the second embodiment of the present invention. From the measurement results, it is observed that the isolation is below −20 dB for the WWAN and UWB systems.

Figure 12:
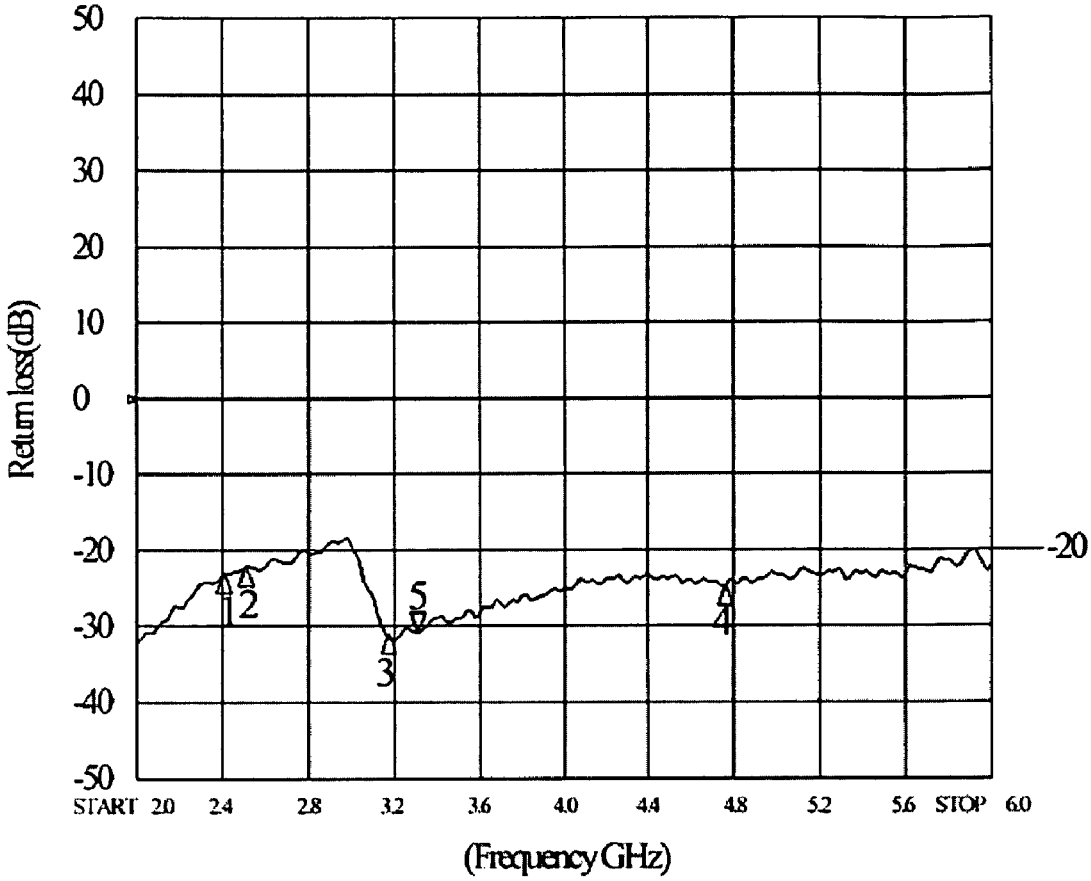
FIG. 12 is a diagram showing the measurement results of the isolation (for the WLAN system and the UWB system) of the multi-antenna module according to the second embodiment of the present invention.

Referring to FIG. 12, a diagram shows the measurement results of the isolation (for the WLAN and UWB systems) of the multi-antenna module according to the second embodiment of the present invention. From the measurement results, it is observed: the isolation is below −20 dB for the WLAN and UWB systems. Therefore, the multi-antenna module of the present invention can indeed inhibit the signal interference between two adjacent antennae and promote the isolation of antennae.

Figure 13:
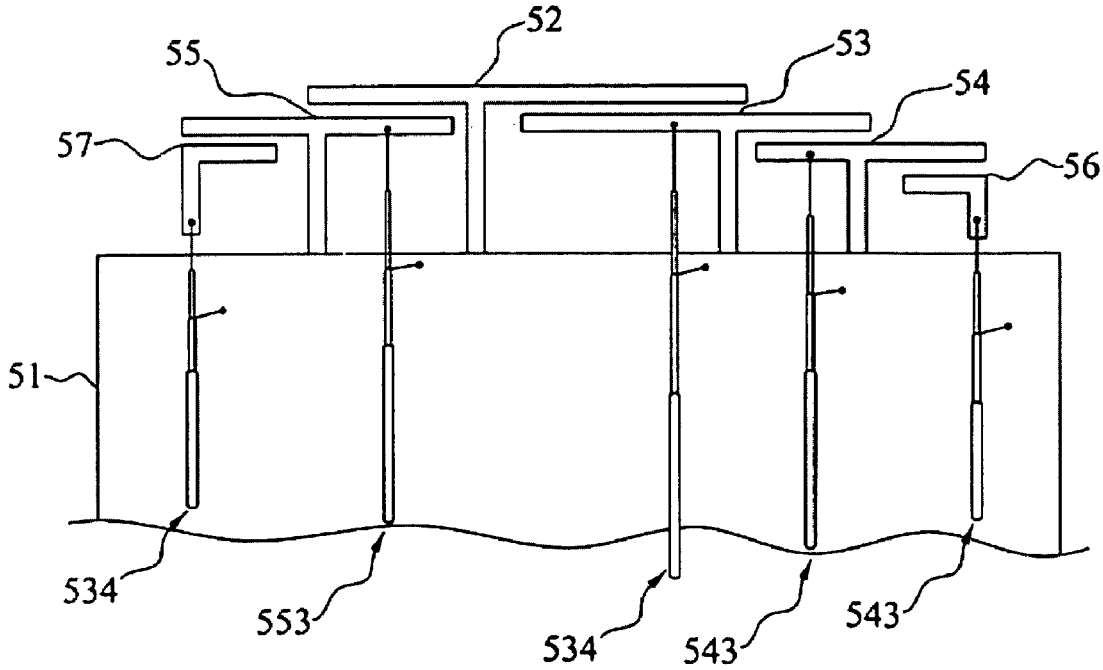
FIG. 13 is a top view of a multi-antenna module according to a third embodiment of the present invention.

A top view of a multi-antenna module according to a third embodiment of the present invention is shown in FIG. 13. The third embodiment is similar to the second embodiment, and the identical or equivalent elements in FIG. 13 use the same numeral notations of the second embodiment. The third embodiment of the present invention has a third coupling conductor 56 and a fourth coupling conductor 57 additionally. The third coupling conductor 56 is arranged beside the first coupling conductor 54 and the secondary conductor 53 and along the direction opposite to the direction of the first coupling conductor 54 and the secondary conductor 53. The fourth coupling conductor 57 is arranged beside the second coupling conductor 55 and the primary conductor 52 and along the direction opposite to the direction of the second coupling conductor 55 and the primary conductor 52. Then, the first coupling conductor 54 and the third coupling conductor 56 excite a resonant mode of a fourth antenna, and the second coupling conductor 55 and the fourth coupling conductor 57 excite a resonant mode of a fifth antenna. Applying the principle used above can infinitely expand the number of antennae in the same antenna structure without reserving additional spacing for adjacent antennae. Thereby, the present invention can achieve antenna miniaturization and multiple operation frequency bands.

What is claimed is:

1. A multi-antenna module comprising a ground plane;

a primary conductor further comprising a first short-circuit member with one end thereof connected to said ground plane; and a primary radiation arm connected to another end of said first short-circuit member and extending from said first short-circuit member along a first direction;

a secondary conductor further comprising a second short-circuit member with one end thereof connected to said ground plane;

a secondary radiation arm connected to another end of said second short-circuit member and extending from said second short-circuit member along a second direction opposite to said first direction, wherein said secondary radiation arm and said primary radiation arm are parallel to each other and have a gap therebetween;

an extension arm connected to a joint of said second short-circuit member and said secondary radiation arm and extending from said second short-circuit member along said first direction; and a first feeder cable connected to said secondary radiation arm;

a coupling conductor further comprising a feeder member;

a coupling arm connected to one end of said feeder member and extending from said feeder member along said second direction, wherein said coupling arm and said extension arm are parallel to each other and have a gap therebetween; and a second feeder cable connected to said feeder member.

2. The multi-antenna module according to claim 1, wherein said coupling conductor further comprises a modulation member.

3. The multi-antenna module according to claim 2, wherein modulation member is used to modulate impedance matching of said coupling conductor.

4. The multi-antenna module according to claim 1, wherein said first feeder cable is used to transmit feed-in signals of a first antenna.

5. The multi-antenna module according to claim 1, wherein said second feeder cable is used to transmit feed-in signals of a second antenna.

6. A multi-antenna module comprising a ground plane;

a primary conductor further comprising a first short-circuit member with one end thereof connected to said ground plane;

a primary radiation arm connected to another end of said first short-circuit member and extending from said first short-circuit member along a first direction; and a first extension arm connected to a joint of said first short-circuit member and said primary radiation arm and extending from said first short-circuit member along a second direction opposite to said first direction;

a secondary conductor further comprising a second short-circuit member with one end thereof connected to said ground plane;

a secondary radiation arm connected to another end of said second short-circuit member and extending from said second short-circuit member along said second direction, wherein said secondary radiation arm and said primary radiation arm are parallel to each other and have a gap therebetween;

a second extension arm connected to a joint of said second short-circuit member and said secondary radiation arm and extending from said second short-circuit member along said first direction; and a first feeder cable connected to said secondary radiation arm;

a first coupling conductor further comprising a first feeder member;

a first coupling arm connected to one end of said first feeder member and extending from said first feeder member along said second direction, wherein said first coupling arm and said second extension arm are parallel to each other and have a gap therebetween; and a second feeder cable connected to said first feeder member;

a second coupling conductor further comprising a second feeder member;

a second coupling arm connected to one end of said second feeder member and extending from said second feeder member along said first direction, wherein said second coupling arm and said first extension arm are parallel to each other and have a gap therebetween; and a third feeder cable connected to said second feeder member.

7. The multi-antenna module according to claim 6, wherein said first feeder cable is used to transmit feed-in signals of a first antenna.

8. The multi-antenna module according to claim 6, wherein said second feeder cable is used to transmit feed-in signals of a second antenna.

9. The multi-antenna module according to claim 6, wherein third feeder cable is used to transmit feed-in signals of a third antenna.

* * * * *